US011308846B2

(12) United States Patent
Hung et al.

(10) Patent No.: US 11,308,846 B2
(45) Date of Patent: Apr. 19, 2022

(54) ELECTRONIC DEVICES WITH COLOR COMPENSATION

(71) Applicant: Apple Inc., Cupertino, CA (US)

(72) Inventors: Po-Chieh Hung, Sunnyvale, CA (US); Zhen Zhang, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/818,945

(22) Filed: Mar. 13, 2020

(65) Prior Publication Data

US 2021/0287586 A1 Sep. 16, 2021

(51) Int. Cl.
*G09G 3/20* (2006.01)
*G09G 3/34* (2006.01)

(52) U.S. Cl.
CPC ..... *G09G 3/2003* (2013.01); *G09G 3/3413* (2013.01); *G09G 2320/0242* (2013.01); *G09G 2320/0666* (2013.01); *G09G 2360/144* (2013.01)

(58) Field of Classification Search
CPC combination set(s) only.
See application file for complete search history.

(56) References Cited

U.S. PATENT DOCUMENTS 10,123,005 B2 11/2018 Gu et al.
10,203,762 B2 2/2019 Bradski et al.
10,277,829 B1 4/2019 Garrido et al.
10,554,962 B2 2/2020 Perdices-Gonzalez et al.
10,578,869 B2 3/2020 Osterhout et al.
2012/0182276 A1* 7/2012 Kee ..... G09G 5/10 345/207
2013/0271438 A1 10/2013 Aflatooni
2014/0159587 A1 6/2014 Sezan et al.
2014/0168278 A1 6/2014 Shi et al.
2015/0229888 A1* 8/2015 Harada ..... A61B 5/6898 348/207.1
2016/0313176 A1 10/2016 Lee
2018/0350323 A1* 12/2018 Whitehead ..... G09G 5/026
2019/0043441 A1 2/2019 Reicher et al.
2019/0301932 A1 10/2019 Sarkar et al.
2019/0318696 A1 10/2019 Imai et al.
2019/0362688 A1 11/2019 Wang et al.

* cited by examiner

*Primary Examiner* — Van N Chow
(74) *Attorney, Agent, or Firm* — Treyz Law Group, P.C.; G. Victor Treyz; Jason Tsai

(57) ABSTRACT

An electronic device may have a camera that captures images of objects that are illuminated by ambient light. Some ambient light sources may not render the colors of objects faithfully. To detect low quality ambient lighting conditions and to correct for these conditions, control circuitry in the electronic device gathers ambient light measurements from a color ambient light sensor. The measurements are used to produce an ambient light spectral power distribution. The ambient light spectral power distribution can be applied to a series of test color samples to produce responses. Responses can also be produced by applying a reference illuminant to the test color samples. These responses can then be processed to generate a color rendering index or other color rendering metric for the ambient light and can be used to create a color correction matrix to correct the color of the captured images.

17 Claims, 6 Drawing Sheets

ELECTRONIC DEVICES WITH COLOR COMPENSATION

FIELD

This relates generally to electronic devices, and, more particularly, to electronic devices that process images.

BACKGROUND

Electronic devices may use cameras to capture images of objects and may use displays to display captured images.

The appearance of an image of an object that is illuminated by a light source is affected by the attributes of the light source. For example, some light sources such as cool white fluorescent lights and street lights have poor color rendering properties and adversely affect image appearance.

SUMMARY

An electronic device may have a camera that captures images of objects that are illuminated by ambient light. Some ambient light sources may not render the colors of objects faithfully. To detect low quality ambient lighting conditions and to correct for these conditions, control circuitry in the electronic device may gather ambient light measurements from a color ambient light sensor. The measurements can be used to produce an ambient light spectral power distribution.

Using the ambient light spectral power distribution, the electronic device may evaluate the color rendering properties of the ambient light. For example, the ambient light spectral power distribution can be applied to a series of test color samples to produce responses. Responses can also be produced by applying a reference illuminant to the test color samples. These responses can then be processed to generate a color rendering index or other color rendering metric for the ambient light and can be used to create a corresponding color correction mapping such as a color correction matrix.

An electronic device may, if desired, compare the color rendering metric to a predetermined threshold value. In response to determining that the color rendering metric is lower than the threshold value (or otherwise determining that the current ambient lighting environment fails to meet a desired level of color rendering quality), the electronic device may issue an alert for a user. The alert may include, for example, a text warning that is displayed on a display in the electronic device. The warning may inform the user of the color rendering metric value and may include an explanation indicating that the current ambient lighting conditions are likely to produce low color quality in a captured image.

The electronic device may use the color correction mapping to correct pixels in the captured image for shortcomings in the ambient lighting conditions. After correction, the captured image will appear as if objects in the captured image were illuminated by ideal or near ideal lighting (e.g., lighting with an ideal or near-ideal color rendering index).

The electronic device may, if desired, save information such as color correction mapping information as part of a captured image file (e.g., as metadata). In some configurations, an electronic device may use a split-screen format to display an uncorrected image side-by-side with a version of the image that has been corrected using the color correction mapping.

DETAILED DESCRIPTION

Electronic devices may be provided with cameras for capturing images. Electronic devices may also be provided with displays. The displays may be used for displaying captured images for users. In some scenarios, a first device captures an image that is displayed on a display of a second device.

Ambient lighting conditions can affect image appearance. For example, images captured under certain lighting such as cool white fluorescent lighting or street lamp lighting may have poor saturation or undesired color casts. To address these issues, an electronic device may be provided with a color ambient light sensor that measures the light spectrum associated with ambient light. This light spectrum can then be evaluated to produce a metric such as a color rendering index that reflects the quality of the light source. If the color rendering index is low, a user of the electronic device may be warned. Corrective action may also be taken on captured images to improve image appearance. For example, a color correction mapping may be applied to an image to correct the image for deficiencies due to poor ambient lighting.

Figure 1:
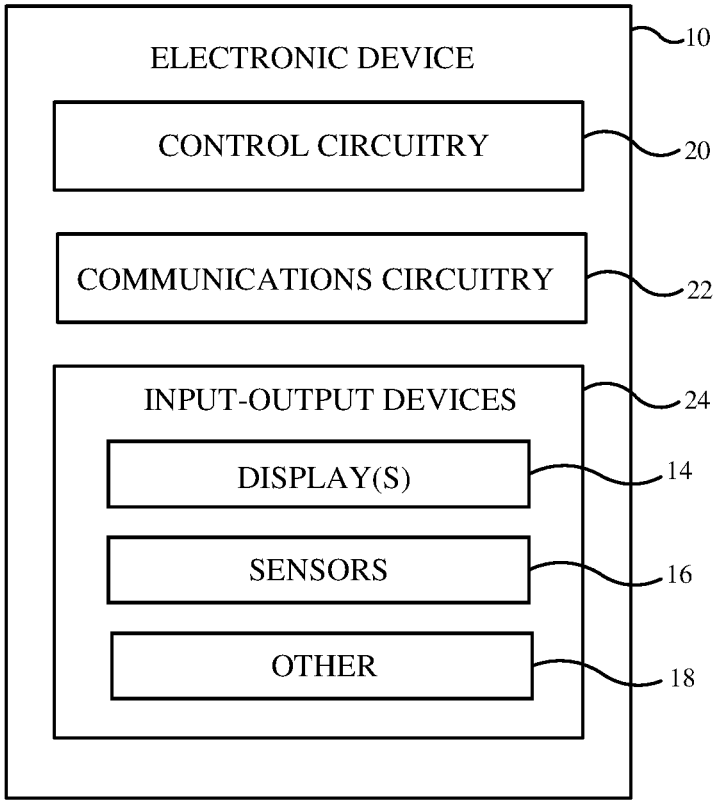
FIG. 1 is a schematic diagram of an illustrative electronic device in accordance with an embodiment.

A schematic diagram of an illustrative electronic device is shown in FIG. 1. Device 10 may be a cellular telephone, tablet computer, laptop computer, wristwatch device, head-mounted device (e.g., googles, a helmet, glasses, etc.), a television, a stand-alone computer display or other monitor, a computer display with an embedded computer (e.g., a desktop computer), a system embedded in a vehicle, kiosk, or other embedded electronic device, a camera (e.g., a single-lens-reflex camera or other stand-alone camera), a video camera, a media player, or other electronic equipment. Device 10 may have a camera for capturing images and a display for displaying images. For example, in a head-mounted device configuration, device 10 may have a forward-facing camera for capturing images of a scene and may have a display that displays the scene and overlaid computer-generated images. Device 10 may have a color ambient light sensor that makes measurements of ambient light (e.g., to estimate the light spectrum of ambient light surrounding device 10). If desired, multiple devices such as device 10 may be used together in a system. For example, a first device 10 such as a cellular telephone may have a camera that captures images and an ambient light sensor that measures ambient light and a second device 10 such as a computer may have a display that displays the captured images. In general, one or more devices such as device 10 may be used by a user to capture images, to make ambient light measurements, and/or to display captured images. Configurations in which a single device 10 performs these operations may sometimes be described herein as an example.

Device 10 may include control circuitry 20. Control circuitry 20 may include storage and processing circuitry for supporting the operation of device 10. The storage and processing circuitry may include storage such as nonvolatile memory (e.g., flash memory or other electrically-programmable-read-only memory configured to form a solid state drive), volatile memory (e.g., static or dynamic random-access-memory), etc. Processing circuitry in control circuitry 20 may be used to gather input from sensors and other input devices and may be used to control output devices. The processing circuitry may be based on one or more microprocessors, microcontrollers, digital signal processors, baseband processors and other wireless communications circuits, power management units, audio chips, application specific integrated circuits, etc. During operation, control circuitry 20 may use a display and other output devices in providing a user with visual output and other output.

To support communications between device 10 and external equipment, control circuitry 20 may communicate using communications circuitry 22. Circuitry 22 may include antennas, radio-frequency transceiver circuitry, and other wireless communications circuitry and/or wired communications circuitry. Circuitry 22, which may sometimes be referred to as control circuitry and/or control and communications circuitry, may support bidirectional wireless communications between device 10 and external equipment over a wireless link (e.g., circuitry 22 may include radio-frequency transceiver circuitry such as wireless local area network transceiver circuitry configured to support communications over a wireless local area network link, near-field communications transceiver circuitry configured to support communications over a near-field communications link, cellular telephone transceiver circuitry configured to support communications over a cellular telephone link, or transceiver circuitry configured to support communications over any other suitable wired or wireless communications link). Wireless communications may, for example, be supported over a Bluetooth® link, a WiFi® link, a wireless link operating at a frequency between 10 GHz and 400 GHz, a 60 GHz link, or other millimeter wave link, a cellular telephone link, or other wireless communications link. Device 10 may, if desired, include power circuits for transmitting and/or receiving wired and/or wireless power and may include batteries or other energy storage devices. For example, device 10 may include a coil and rectifier to receive wireless power that is provided to circuitry in device 10.

Device 10 may include input-output devices such as devices 24. Input-output devices 24 may be used in gathering user input, in gathering information on the environment surrounding the user, and/or in providing a user with output. Devices 24 may include one or more displays such as display 14. Display 14 may be an organic light-emitting diode display, a liquid crystal display, an electrophoretic display, an electrowetting display, a plasma display, a microelectromechanical systems display, a scanning mirror display, a display having a pixel array formed from crystalline semiconductor light-emitting diode dies (sometimes referred to as microLEDs), and/or other display. If desired, display 14 may be a touch-sensitive display.

Sensors 16 in input-output devices 24 may include force sensors (e.g., strain gauges, capacitive force sensors, resistive force sensors, etc.), audio sensors such as microphones, touch and/or proximity sensors such as capacitive sensors (e.g., a two-dimensional capacitive touch sensor integrated into display 14, a two-dimensional capacitive touch sensor overlapping display 14, and/or a touch sensor that forms a button, trackpad, or other input device not associated with a display), and other sensors. If desired, sensors 16 may include optical sensors such as optical sensors that emit and detect light, ultrasonic sensors, optical touch sensors, optical proximity sensors, and/or other touch sensors and/or proximity sensors, monochromatic and color ambient light sensors, image sensors (e.g., a camera operating at visible light wavelengths, infrared wavelengths, and/or ultraviolet light wavelengths), fingerprint sensors, temperature sensors, sensors for measuring three-dimensional non-contact gestures ("air gestures"), pressure sensors, sensors for detecting position, orientation, and/or motion (e.g., accelerometers, magnetic sensors such as compass sensors, gyroscopes, and/or inertial measurement units that contain some or all of these sensors), health sensors, radio-frequency sensors, depth sensors (e.g., structured light sensors and/or depth sensors based on stereo imaging devices that capture three-dimensional images), optical sensors such as self-mixing sensors and light detection and ranging (lidar) sensors that gather time-of-flight measurements, humidity sensors, moisture sensors, gaze tracking sensors, and/or other sensors. In some arrangements, device 10 may use sensors 16 and/or other input-output devices to gather user input. For example, buttons may be used to gather button press input, touch sensors overlapping displays can be used for gathering user touch screen input, touch pads may be used in gathering touch input, microphones may be used for gathering audio input, accelerometers may be used in monitoring when a finger contacts an input surface and may therefore be used to gather finger press input, etc.

If desired, electronic device 10 may include additional components (see, e.g., other devices 18 in input-output devices 24). The additional components may include haptic output devices, audio output devices such as speakers, light-emitting diodes for status indicators, light sources such as light-emitting diodes that illuminate portions of a housing and/or display structure, other optical output devices, and/or other circuitry for gathering input and/or providing output. Device 10 may also include a battery or other energy storage device, connector ports for supporting wired communication with ancillary equipment and for receiving wired power, and other circuitry.

Figure 2:
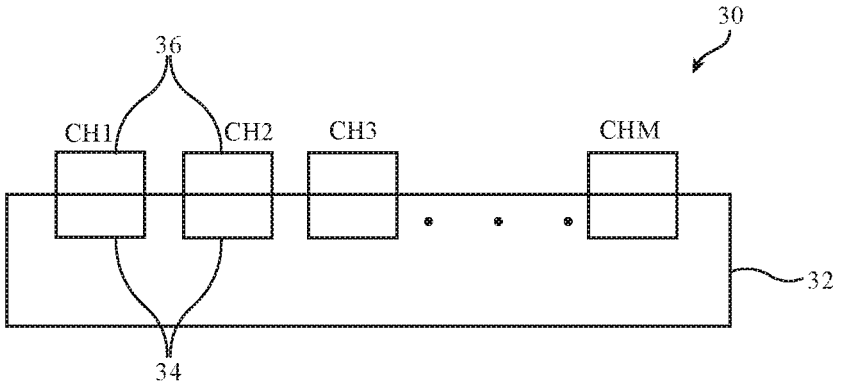
FIG. 2 is a cross-sectional side view of an illustrative color ambient light sensor in accordance with an embodiment.
Figure 3:
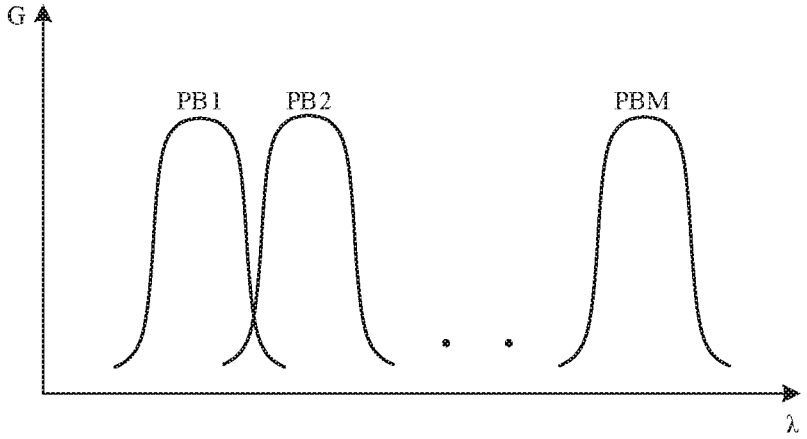
FIG. 3 is a graph in which the sensitivity of a multichannel ambient light sensor has been plotted as a function of wavelength in accordance with an embodiment.

FIG. 2 is a cross-sectional side view of an illustrative color ambient light sensor for device 10. As shown in FIG. 2, color ambient light sensor 30 may have multiple photodetectors 34 each of which is associated with a respective channel (e.g., CH1, CH2, CH3, . . . CHM). There may be M channels in sensor 30, each of which gathers light of a different color (a different respective band of wavelengths). The value of M may be at least 3, at least 5, at least 8, at least 15, less than 25, less than 10, less than 6, 4-12, or other suitable value. Each photodetector 34 may be formed from a photosensitive device such as a photodiode in semiconductor substrate 32 (e.g., a silicon substrate) and may be overlapped by a respective color filter 36. Color filters 36 may use thin-film interference filters and/or colored layers (layers colored with dye and/or pigment). Each color filter 36 may have a different respective pass band, so that the photodetectors of different channels are sensitive to light of different colors. For example, one color filter may pass blue light, another color filter may pass green light, etc.). Illustrative pass bands PB1, . . . PBM for channels CH1, . . . CHM are shown, respectively, in the graph of FIG. 3, in which photodetector gain G has been plotted as a function of wavelength λ. The sensitivity curves for photodetectors 34 may overlap (if desired). Visible light wavelengths and, if desired, additional wavelengths such as infrared wavelengths and/or ultraviolet light wavelengths may be covered by sensor 30. In an illustrative configuration, the channels of sensor 30 are visible light channels and measurements from sensor 30 are used to estimate the visible ambient light spectrum of ambient light surrounding device 10 (e.g., ambient light that is illuminating objects in the field of view of the camera of device 10 while the camera is capturing images of the illuminated objects). The visible-light ambient light spectrum measured by sensor 30 may sometimes be referred to as an ambient light spectral power distribution, a spectral power distribution of ambient light, an estimated spectral power distribution of light, etc. Here, spectral power distribution may not be a continuous curve and may be represented by discrete data such as raw sensor signals or data derived from raw sensor signals.

Color ambient light sensor 30 may make ambient light measurements to detect poor lighting conditions. A user of device 10 may then be warned of the poor lighting conditions, images can be corrected using a corrective color mapping that is derived from the ambient light measurements, and/or other action may be taken.

Figure 4:
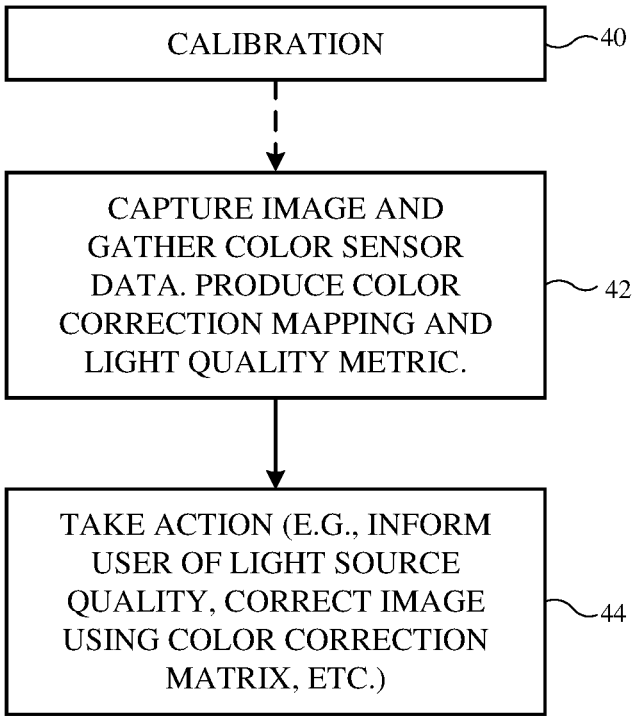
FIG. 4 is a flow chart of illustrative operations involved in using an electronic device to gather ambient light measurements and capture images in accordance with an embodiment.

FIG. 4 is a flow chart of illustrative operations involved in using device 10. During the operations of block 40, device 10 can be calibrated. For example, sensor 30 may be exposed to multiple different sample light sources each of which has a known spectrum. The outputs of channels CH1 . . . CHM in response to each of these test spectrums may then be recorded. After sufficient data has been collected, the responses of channels CH1 . . . CHM may be calibrated based on the tests. This allows future measurements of ambient light with sensor 30 (i.e., the measured output values of channels CH1 . . . CHM) to be used to estimate the spectrum of the measured ambient light.

During the operations of block 42, device 10 may capture an image using a camera (a visible light image sensor) in sensors 16 and may make an ambient light measurement using color ambient light sensor 30.

The color ambient light measurement may be processed to produce a color mapping. The color mapping may be implemented using a color correction matrix or a color correction look-up table and may be used to correct images for defects in color that arise from shortcomings in the ambient light environment. The color mapping, which may sometimes be referred to as a color correction matrix, may be used to adjust hue, saturation, and luminance independently (unlike a white point adjustment in which the hue, saturation, and luminance for each pixel is corrected in the same way—using, for example, RGB gain control).

The color ambient light measurements may also be used to produce a color rendering index, a gamut area index, or other metric that quantifies ambient light quality (e.g., the ability of the ambient light to serve as an illuminate the faithfully reveals the colors of objects compared to an ideal light source). An example of a color rendering metric is the CIE (International Commission on Illumination) color rendering index (CRI). Metrics other than the CIE CRI may be computed based on the ambient light measurements from sensor 30, if desired. The use of the CIE CRI as an ambient light color rendering metric is illustrative. Other examples of color rendering indices are Rf/Rg of IES TM-30 and CIE Color Fidelity Index.

During the operations of block 44, device 10 may take suitable actions based on the processing operations of block 42. As an example, device 10 may compare the computed ambient light color rendering metric to a predetermined threshold value. If the metric is below the threshold, the user may be alerted that current ambient lighting conditions are poor. If desired, the color mapping and/or the color rendering metric may be appended to a captured image file (e.g., as metadata) and/or the color mapping may be applied to the image data. By applying the color mapping, the image may be corrected for color issues related to the current ambient lighting conditions. For example, defects in hue, saturation, and luminance may be corrected.

Figure 5:
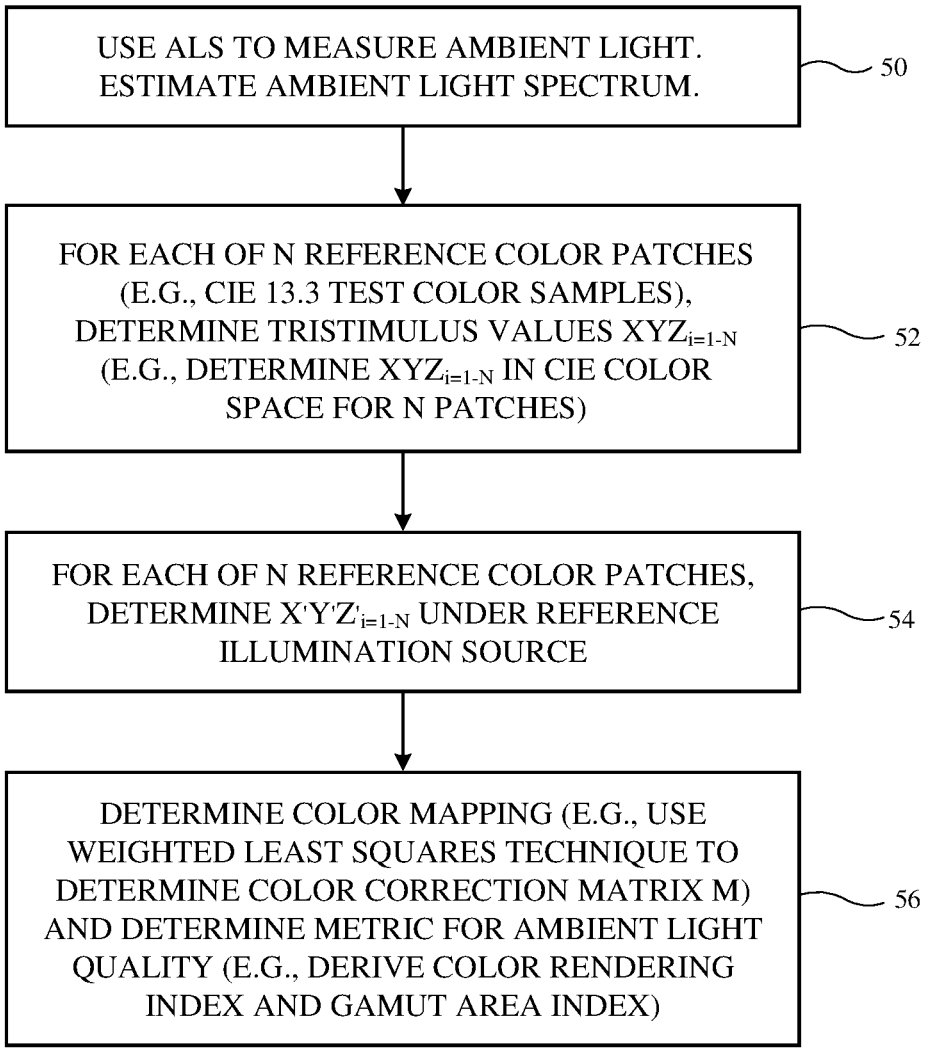
FIG. 5 is a flow chart of illustrative operations associated with producing a color correction mapping such as a color correction matrix in accordance with an embodiment.

The flow chart of FIG. 5 shows illustrative operations associated with producing a color correction mapping and ambient light color rendering metric. During the operations of block 50, device 10 uses color ambient light sensor (ALS) 30 to measure the spectrum of the ambient light that is surrounding device 10 and that is illuminating objects in the user's vicinity. The color ambient light sensor measures the ambient light spectrum by taking ambient light color measurements using the multiple color channels in sensor 30. The readings from the color channels may then be used to estimate the ambient light spectrum.

The ability of the ambient light to serve as an illuminate that faithfully reveals the colors of objects can be ascertained comparing the response of reference color patches (e.g., CIE 13.3 test color samples or other known color samples) when illuminated by the ambient light to the response of the reference color patches when illuminated by an ideal (reference) illumination source. Ideal performance is achieved when the ambient light spectrum exhibits ideal illumination source characteristics. In practice, ambient lighting conditions are not ideal and therefore fall short of ideal to some degree. An ambient light spectrum that is close to ideal will render colors accurately when illuminating objects, whereas an ambient light spectrum that has spectral gaps or other undesired spectral properties will render colors poorly.

During the operations of block 52, the response of each of N reference color patches is determined when exposed to the measured ambient light spectrum. The value of N may be at least 3, at least 5, at least 7, at least 9, fewer than 25, fewer than 15, fewer than 10, or other suitable value. As an example, N may be 8. A response (in XYZ color space or other suitable color space) may be computed as each of the N reference color patches is exposed to the measured ambient light spectrum. For example, if N is 8, a 3×8 matrix A (XYZ, for N=1 to 8) may be computed.

During the operations of block 54, the response of each of the N reference color patches is determined when exposed to a reference illumination source (e.g., an ideal illumination source with a continuous spectrum). As each color patch is exposed to the reference illumination spectrum, a corresponding response X'Y'Z' may be calculated (e.g., in XYZ color space). For example, if N is 8, a 3×8 matrix B (X'Y'Z' for N=1 to 8) may be calculated.

During the operations of block 56, a color correction mapping (e.g., a color mapping matrix M) may then be determined based on the values of A and B, using the relationship MA B. In determining M from A and B, a least squares method or other suitable fitting technique may be used. If desired, a weighted least squares technique may be used in determining the value of M. The weighted least squares technique may, as an example, assign different weights to the different reference color patches. Reference color patches corresponding to skin tones and other colors considered to be important may be provided with higher weights than other colors. The value of M may be used to map image colors for images captured under the current ambient lighting conditions to ideal image colors (e.g., M may be used to correct images captured under poor ambient lighting conditions so that objects in the image appear to have been illuminated under an ideal or nearly ideal light source. The use of color mapping matrix (color correcting matrix) M to represent the color correction mapping is illustrative. A look-up table or other arrangement may be used to represent the color correction mapping, if desired.

During the operations of block 56, one or more metrics representing the color rendering quality of the ambient light spectrum may be computed. As an example, a color rendering index such as the CIE Ra value may be computed from matrices A and B. Color metrics such as a gamut area index and/or other color rendering metrics for the current light spectrum may also be calculated.

It may be desirable to correct captured images using the color correction mapping (e.g., color mapping matrix M). For example, consider a user capturing images with device 10 and viewing the captured images on display 14. If the images are captured in poor ambient lighting, the images will not have an attractive appearance. To enhance the appearance of the captured images, the pixel values of each image may be corrected by applying color mapping matrix M. Illustrative operations associated with correcting a captured image (e.g., a captured image with pixel values in RGB color space) are shown in FIG. 6.

Figure 6:
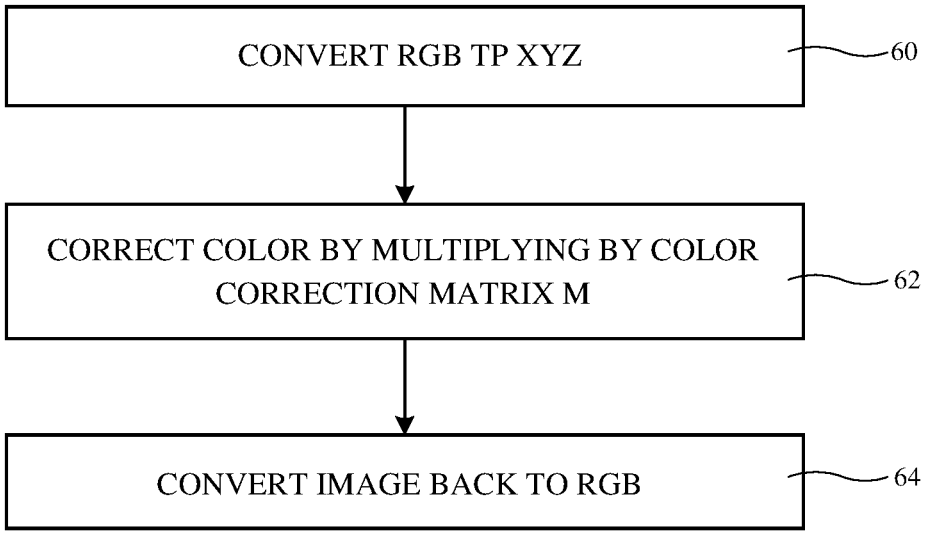
FIG. 6 is a flow chart of illustrative operations associated with using a color correction matrix in accordance with an embodiment.

During the operations of block 60 of FIG. 6, the captured image is converted from RGB color space to XYZ color space.

During the operations of block 62, the color of the image is corrected by multiplying the pixel values of the image by color correction matrix M. This produces a color-corrected image in XYZ color space.

During the operations of block 64, the image may be converted from XYZ color space to RGB color space, so that the image may be saved as an RGB image file and/or so that the image may be reproduced for viewing using an RGB display. In saving the corrected image (or in saving captured raw images without correction), the information produced during the operations of FIG. 5 (e.g., the color correction mapping such as the values in matrix M, the color rendering metric for the ambient light spectrum such as the color rendering index, etc.) may be saved as metadata or otherwise appended and/or associated with the saved image data. For example, each uncorrected captured image and/or each color-corrected image produced by device 10 may have an extension that includes M and CRI (as an example).

As described in connection with the operations of block 44 of FIG. 4, device 10 may take various actions based on: the captured image, the measured ambient light spectrum, the color correction mapping, and/or the ambient light color rendering metric. As an example, captured images may be automatically color corrected using the mapping, color mapping matrix M and/or a color rendering metric may be appended to an image file, alerts may be presented to a user, and/or other information may be presented.

Figure 7:
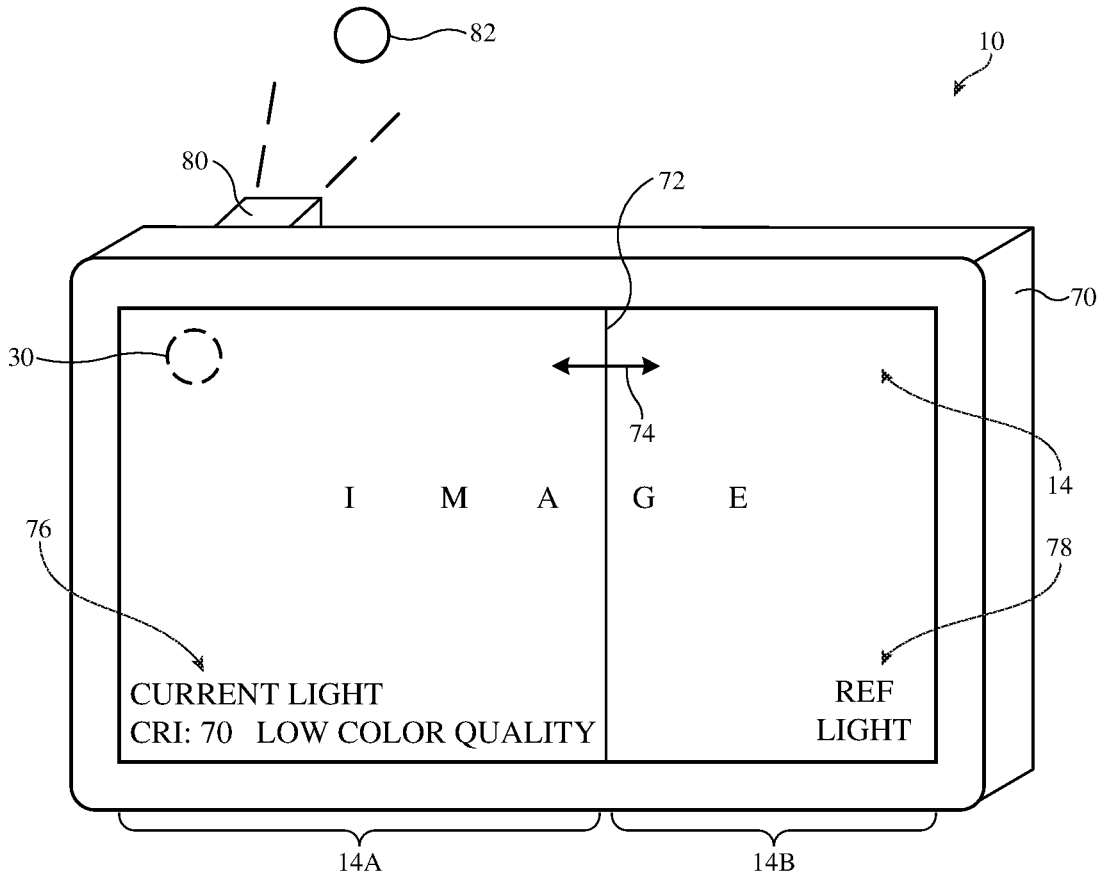
FIG. 7 is a perspective view of an illustrative electronic device that is displaying an alert (e.g., a textual warning or other warning) in response to detection of a color rendering index that is lower than a predetermined threshold value in accordance with an embodiment.

Consider, as an example, the scenario of FIG. 7. In the example of FIG. 7, camera 80 of device 10 is being used by a user to capture an image of object 82. Device 10 may have a display such as display 14 mounted in a housing such as housing 70. Display 14 may, for example, be mounted on the front face of housing 70. Camera 80 may be mounted on an opposing rear face of housing 70 or may be provided elsewhere in device 10. Device 10 may have a color ambient light sensor mounted on the front, rear, or side of device 10. For example, color ambient light sensor 30 may be mounted on the front face of device 10 or may be mounted adjacent to camera 80 on the rear face of device 10. Sensor 30 may operate through a clear window, may operate through a transparent housing wall, may operate though part of display 14, etc.

When a user captures an image of object 82, color ambient light sensor 80 may measure current ambient lighting conditions (e.g., to measure the current ambient light spectrum). Color correction matrix M may then be determined and applied to the captured image to produce a corrected color image. An ambient light color rendering metric such as a color rendering index (CRI) may be computed and compared to a predetermined threshold value (e.g., 85). If the value of CRI is lower than the threshold, device 10 can conclude that the color rendering quality of the current ambient light is poor and can issue an alert for the user of device 10. For example, in region 76, an alert message such as "CURRENT LIGHT CRI: 70 LOW COLOR QUALITY". This message informs the user of the CRI associated with the current ambient lighting conditions and informs the user that the CRI is poor so that image color quality is expected to be low. The user may then take corrective action such as correcting the color in device 10 or on another electronic device.

In addition to displaying an alert message in response to detection of a low CRI value, device 10 may use a split screen format to simultaneously display both the uncorrected version of the captured image and a corrected version of the present the user with a comparison of the uncorrected version of the captured image and a corrected version of the captured image. The split screen may contain left-hand portion 14A and right-hand portion 14B. Movable divider 72 may be moved by a user (e.g., by dragging a finger back and forth in directions 74 in scenarios in which display 14 is a touch screen).

Display portion 14A may be used to display an uncorrected portion of the captured image. Display portion 14B may be used to display a corrected portion of the captured image to which color correction mapping M has been applied. The text "CURRENT LIGHT" may be displayed in region 76 of display portion 14A to indicate that portion 14A corresponds to the image captured in the current ambient lighting environment. The text "REF LIGHT" or other suitable label may be applied in region 78 of display portion 14B to indicate that the image in display portion 14B corresponds to an ideal (or nearly ideal) lighting condition. The image displayed in portion 14B may correspond to the original captured image after color correction mapping M has been applied to correct the color of the original capture image.

If desired, the user of device 10 may be provided with an opportunity to turn on or turn off automatic color correction operations (e.g., the control circuitry of device 10 may present a selectable option for the user on display 14). The user may also select whether to include or to not include the color correction matrix to recorded captured image files. In scenarios in which a user is being warned about low-color-quality light sources, a user may be encouraged to use a camera flash (strobe light). The use of color correcting matrix M may help prevent undesired yellowing of skin tones from low quality fluorescent lamps or streetlights (as examples) in displayed images.

In head-mounted devices (e.g., a device such as device 10 that has lenses in between display 14 and eye boxes in which the user's eyes are located and that has a strap or other head-mounted support structure so that device 10 can be worn on a user's head), the use of color correcting matrix M may help ensure that displayed real-world images from a forward-facing camera have an appearance that is satisfactory (no yellowed skin tones, etc.). This may help device 10 satisfactorily merge real-world images from the forward-facing camera with computer-generated (virtual) content (e.g., clashing color appearances can be avoided).

The color correction matrix M may be formed using any suitable number of color patches and may have any suitable number of elements. For example, the number of color patches may be at least 5, at least 8, at least 12, at least 15, 8-15, less than 20, etc. The color correction mapping (e.g., matrix M) may be realized in any device-independent color space. For example, the color correction mapping may be defined in a device-independent color space such as XYZ, sRGB, Yu'v', a color space that is a derivative of one of these color spaces (e.g., a derivative of XYZ, a derivative of sRGB, or a derivative of Yu'v'), etc. Matrix M (or a color look-up table) for correcting color may be stored as metadata in an image file (e.g., using a file format such as the exchangeable image file format (Exif), JPEG 200, etc. This allows a user to compensate images at a later time (e.g., during post-processing). The metadata may, for example, be used in conjunction with images captured in a raw file format such as DNG.

Device 10 may, if desired, be used in real-time viewing. For example, a user may use device 10 to display a real-time video image on display while capturing video with a rear-facing camera. The real-time video image may be color corrected. This allows a user to view objects as they would appear under normal (near ideal) lighting, even if the current lighting of the objects is not ideal. This may occur, for example, when a supermarket uses non-ideal lights to illuminate food. By using device 10, the user can effectively cancel the distortion imposed by non-ideal lighting.

In general, any type of image (e.g., captured images) from a sensor and/or images synthesized by computers or other processors (sometimes referred to as computer-generated images, virtual images, etc.), video, and/or other captured images may be color corrected using color correction matrix M.

The foregoing is merely illustrative and various modifications can be made to the described embodiments. The foregoing embodiments may be implemented individually or in any combination.

Table of Reference Numerals

| | | | |
|---|---|---|---|
| 10 | Electronic Device | 20 | Control Circuitry |
| 22 | Communications Circuitry | 24 | Input-Output Devices |
| 14 | Display | 16 | Sensors |
| 18 | Other | 30 | Color Ambient Light Sensor |
| 34 | Photodetectors | 36 | Filters |
| 32 | Substrate | 40, 42, 44, 50, 52, 54, 56, 60, 62, and 64 | Operations Using Device |
| 82 | Object | 72 | Line |
| 74 | Directions | 70 | Housing |
| 78, 76 | Regions | 14A, 14B | Display Portions |
| 80 | Camera | | |

What is claimed is:

1. An electronic device, comprising:
a housing;
a display in the housing;
a camera configured to capture an original image;
a color ambient light sensor; and
control circuitry configured to
determine a color rendering metric based on information from the color ambient light sensor,
color correct the original image based on the color rendering metric to produce a corrected image, and
present the corrected image on the display.

2. The electronic device defined in claim 1 wherein the color rendering metric comprises a color rendering index.

3. The electronic device defined in claim 2 wherein the control circuitry is configured to display the color rendering index on the display.

4. The electronic device defined in claim 2 wherein the control circuitry is configured to save the color rendering index with a file for the original image.

5. The electronic device defined in claim 2 wherein the control circuitry is configured to display a warning on the display in response to determining that the color rendering index is lower than a predetermined threshold.

6. The electronic device defined in claim 1 wherein the information from the color ambient light sensor comprises an ambient light spectral power distribution.

7. The electronic device defined in claim 6 wherein the control circuitry is configured to generate a color correction mapping based on the ambient light spectral power distribution.

8. The electronic device defined in claim 7 wherein the color correction mapping comprises a mapping selected from the group consisting of: a color correction matrix and a color correction look-up table.

9. The electronic device defined in claim 7 wherein the color correction mapping is defined in a device-independent color space and wherein the device-independent color space comprises a color space selected from the group consisting of: an XYZ color space, an RGB color space, a Yu'v' color space, and a color space that is a derivative of the XYZ color space, the RGB color space, or the Yu'v' color space.

10. The electronic device defined in claim 6 wherein the control circuitry is configured to generate a color correction mapping based on the ambient light spectral power distribution, and wherein the control circuitry is configured to apply the color correction mapping to the original image to produce the corrected image.

11. The electronic device defined in claim 10 wherein the control circuitry is further configured to present on the display an uncorrected version of the original image.

12. The electronic device defined in claim 11 wherein the control circuitry is configured to simultaneously display the uncorrected version of the original image and the corrected image on the display in a split screen format.

13. The electronic device defined in claim 1 wherein the control circuitry is configured to save a file for the original image and wherein the control circuitry is configured to save the color rendering metric as metadata in the file.

14. The electronic device defined in claim 1 wherein the color ambient light sensor has 3 to 30 channels, wherein the image is illuminated by ambient light, and wherein the control circuitry is configured to determine a color rendering index value for the ambient light based on information from the color ambient light sensor.

15. The electronic device defined in claim 14 wherein the control circuitry is configured to determine whether the color rendering index is below a threshold value and wherein the control circuitry is configured to display a message on the display in response to determining that the color rendering index is below the threshold value.

16. The electronic device defined in claim 14 wherein the control circuitry is configured to color correct the original image using a color correction mapping determined using the information from the color ambient light sensor.

17. The electronic device defined in claim 16 wherein the control circuitry is configured to produce the color correction mapping by computing a) responses of test color samples to an ambient light power density spectrum obtained from the information from the color ambient light sensor and b) responses of the test color samples to reference illumination.

* * * * *